US006000174A

United States Patent [19]

Yamazaki

[11] Patent Number: 6,000,174

[45] Date of Patent: Dec. 14, 1999

[54] RETRACTABLE STAIRS-LIKE STAND

[75] Inventor: Ryokichi Yamazaki, Tokyo, Japan

[73] Assignee: Kotobuki Corporation, Tokyo, Japan

[21] Appl. No.: 09/093,679

[22] Filed: Jun. 9, 1998

[30] Foreign Application Priority Data

Jun. 12, 1997 [JP] Japan ..... 9-154893

[51] Int. Cl.[6] ..... E04H 3/12

[52] U.S. Cl. ..... 52/9; 52/8; 52/10; 297/235

[58] Field of Search ..... 52/8, 9, 10; 297/354.13, 297/236, 235, 340

[56] References Cited

U.S. PATENT DOCUMENTS

| | | | |
|---|---|---|---|
| 177,526 | 5/1876 | Lawrence | 297/236 X |
| 207,539 | 8/1878 | Mellinger | 297/236 X |
| 1,656,931 | 1/1928 | Wolfermann | 297/236 |
| 2,987,111 | 6/1961 | Walworth | 52/9 |
| 3,352,069 | 11/1967 | Curra, Jr. | 297/236 X |
| 4,703,043 | 10/1987 | Suzuki | 52/9 |
| 5,517,789 | 5/1996 | Sugiyama | 52/8 X |
| 5,653,502 | 8/1997 | Kimura et al. | 52/9 X |
| 5,740,989 | 4/1998 | Daines | 297/236 X |

FOREIGN PATENT DOCUMENTS

| | | | |
|---|---|---|---|
| 0369094 | 5/1990 | European Pat. Off. | 52/8 |

*Primary Examiner*—Beth Aubrey
*Assistant Examiner*—Brian E. Glessner
*Attorney, Agent, or Firm*—Young & Thompson

[57] ABSTRACT

A retractable, stairs-like stand includes plural steps of floor-bases which are moved horizontally between the advanced position where the floor-bases are mutually shifted into a form of stairs and the retracted position where the floor-bases are mutually lined up along the vertical direction, and plural seats fitted onto the floor-bases. The front portions of the respective floor-bases are equipped with parallel link mechanism for parallel moving the seat sections of the seats back and forth between the use-position where the seat sections of the seats are spaced from the floor-bases and the descent position where the seat sections of the seats are adjacent the floor-bases. Fastening mechanisms are disposed for selectively fixing the seat sections to the use-position and the fastening position where releasing the sections from the use-position. Rear link members are jointed to the backs so as to rotate the back of the seats following the rotation of the front and rear link members constituting the parallel link mechanism, between the use-position where the backs of the seats stand up away from the floor-bases and the collapsed position where, behind the descent position, the backs are adjacent the floor-bases lying on their back faces.

16 Claims, 9 Drawing Sheets

1
2
2a
3
3a
3b
4
5
6
9
10
11

RETRACTABLE STAIRS-LIKE STAND

BACKGROUND OF THE INVENTION

1. Field of the Invention

The present invention relates to a retractable, stairs-like stand which includes plural steps of floor-bases which are moved horizontally between an advanced position where the floor-bases are mutually shifted into a form of stairs and a retracted position where the floor-bases are mutually lined up along the vertical direction, and plural seats fitted onto the floor-bases, which can be compactly put together when the stands are not used.

2. Description of the Related Art

A typical arrangement of such retractable stairs-like stand is disclosed in Japanese Utility Model Application Laid-Open 61-113867. In this conventional the stairs-like stand, the seat sections of the respective seats are fixed onto the front end portions of the respective floor-bases, and the lower end portions of the backs of the respective seats are rotatably joined to the rear end portions of the seat sections, so that the backs can be pushed down onto the seat sections to overlap the seat sections.

However, in the above-mentioned, conventional retractable stairs-like stand, the seat sections of the respective seats and the backs which are pushed down onto the seat sections to overlap the seat sections are received and held inside gaps between the floor-bases lined up along the vertical direction at the retracted position, when the stands are not used. Therefore, the thickness of the seats when received and held becomes large, thereby resulting in the problem that the seats lined up along the vertical direction cannot be held inside the gaps between the floor-bases, in the case in which the difference in level between the floor-bases is small which is usually determined on the basis of the specification of the stands corresponding to the place where the stands are installed.

SUMMARY OF THE INVENTION

It is therefore an object of the present invention to provide a retractable stairs-like stand for advantageously overcoming the above-mentioned problems.

To this end, according to the present invention, there is provided a retractable stairs-like stand comprising plural steps of floor-bases which are moved horizontally between an advanced position where the floor-bases are mutually shifted into a form of stairs and a retracted position where the floor-bases are mutually lined up along the vertical direction, and plural seats fitted onto the floor-bases, said stand further comprising:

parallel link mechanisms for moving seat sections of the seats in parallel while moving back and forth between the use-position where the seat sections of the seats are away from the floor-bases and the descent position where the seat sections of the seats approximate to the floor-bases, at the front portions of the respective floor-bases, fixing means for selectively fixing the seat sections to the use-position or releasing them from the use-position, and jointing at least one of plural link members constituting the parallel link mechanism to backs of the seats, so that the backs can be rotated between the use-position where the backs stand up way from the floor-bases and the collapsed position where the backs approximate to the floor-bases behind the descent position of the seat sections to lie on their back faces, following the rotation of the plural link members.

When the stairs-like stand according to the present invention is used, the plural steps of the floor-bases are moved into the advanced position where they are mutually shifted into a form of stairs, and subsequently or simultaneously the seat sections of the seats are moved forwards in parallel, by the rotation of the plural link members of the parallel link mechanisms on the front portions of the respective floor-bases. Thus, the seat sections are positioned at the use-position where the sections are spaced from the floor-bases. Simultaneously the backs jointed to at least one of the link members are rotated. Thus, the backs are positioned at the use-position where the backs stand up away from the floor-bases. In this state, the seat sections are fixed to the use-position with the fixing means. In this manner, the retractable stairs-like stands are expanded and spread.

When the stand according to the present invention is not in use, the seat sections are released from the use-position with the fixing means and then the seat sections of the seats are moved backwards in parallel, by reverse rotation (to that in use) of the plural link members of the parallel link mechanisms on the front portions of the respective floor-bases. Thus, the seat sections are positioned at the descent position where the seat sections approximate to the floor-bases. Simultaneously, the backs jointed to at least one of the link members are rotated so that the backs are positioned at the collapsed position where the backs approximate to the floor-bases to lie on their back faces. Subsequently or simultaneously, the plural steps of the floor-bases are moved to the retracted position where the plural seats are lined up along the vertical direction, whereby the plural seats are received between the plural steps of the floor-bases and lined up in the vertical direction. Thus, the plural steps of the floor-bases and the plural seats fitted thereto are contracted and received to be put together in a compact body.

When the stairs-like stand according to the present invention is not in use, the plural seats are arranged between the plural steps of the floor-bases so that the seat section and the back of each seat do not overlap and are arranged back and forth. Therefore, even with a small difference in levels between the floor-bases which is fixed by the specification corresponding to the installment space, the seats can be lined up along the vertical direction to be received inside the gaps between the floor-bases. The thickness of the seat section and the back can be also set to a thick value within the range of the gaps between the floor-bases, and the comfortableness of the seats can be improved.

In the stairs-like stand according to the invention, a driving means may be disposed to rotate the respective seat sections in at least one direction between the use-position and the descent position. In this case, the seat sections of the seats can be automatically moved between the use-position and the descent position by means of the driving means, during the period when the plural floor-bases are horizontally moved between the advanced position where the they are manually shifted into a from of stairs, and the retracted position where they are lined up along the vertical direction. Following this movement, the backs of the seats can be moved between the use-position and the collapsed position. Therefore, it is possible to easily perform at least one of the expand/spread of the stairs-like stands and the contraction/receipt thereof for a short time.

In the stairs-like stands according to the invention, the plural link members may be at the right and left sides of the seat sections. In this case, the parallel link mechanisms do not overlap the seat sections in the vertical direction.

Accordingly, the thickness of the seat sections can be made thick within the limited space for receiving the seats.

In the stairs-like stands according to the invention, the plural link members may be disposed below the seat sections. In this case, the parallel link mechanisms are not positioned at the sides of the seat sections; therefore, the thickness of the seat sections can be made even thicker within the limited space for receiving the seats.

In the stairs-like stands according to the invention, another link mechanism may be disposed for moving armrests jointed to the parallel link mechanisms in parallel while moving back and forth between the use-position where the armrests are away from the floor-bases and the descent position where the armrests approximate to the floor-base. In this case, by means of another parallel link mechanism the armrest can be positioned, following the movement of the seat sections and the backs, at the use-position where the armrest is away from the floor-base, in not using the stands. On the contrary, in using the stands, the armrest can be positioned at the descent position where the armrest approximates to the floor-base. Thus, the seating comfort provided by the seats can be further improved.

In the stairs-like stands according to the invention, the plural seat sections may be jointed in an integrated bod, and moved by the parallel link mechanisms between the use-position and the descent position in a manner that the seat sections are put together. In this case, the number of the parallel link mechanisms is reduced less than that of the seat sections. Thus, it is possible to make the structure of the stands simple and to lower the cost for manufacturing the stands.

In the stairs-like stands according to the invention, the plural backs may be jointed in an integrated body, rotated between the use-position and the collapsed position in a manner that the backs are put together. In this case, the number of the link members jointed to the backs is reduced. Thus, it is possible to make the structure of the stands simple and to lower the cost for manufacturing the stands.

BRIEF DESCRIPTION OF THE DRAWINGS

The present invention will be explained in further detail, with reference to some preferred embodiments illustrated in the attached drawings wherein.

DESCRIPTION OF THE PREFERRED EMBODIMENT

Figures 1A, 1B, 1C:
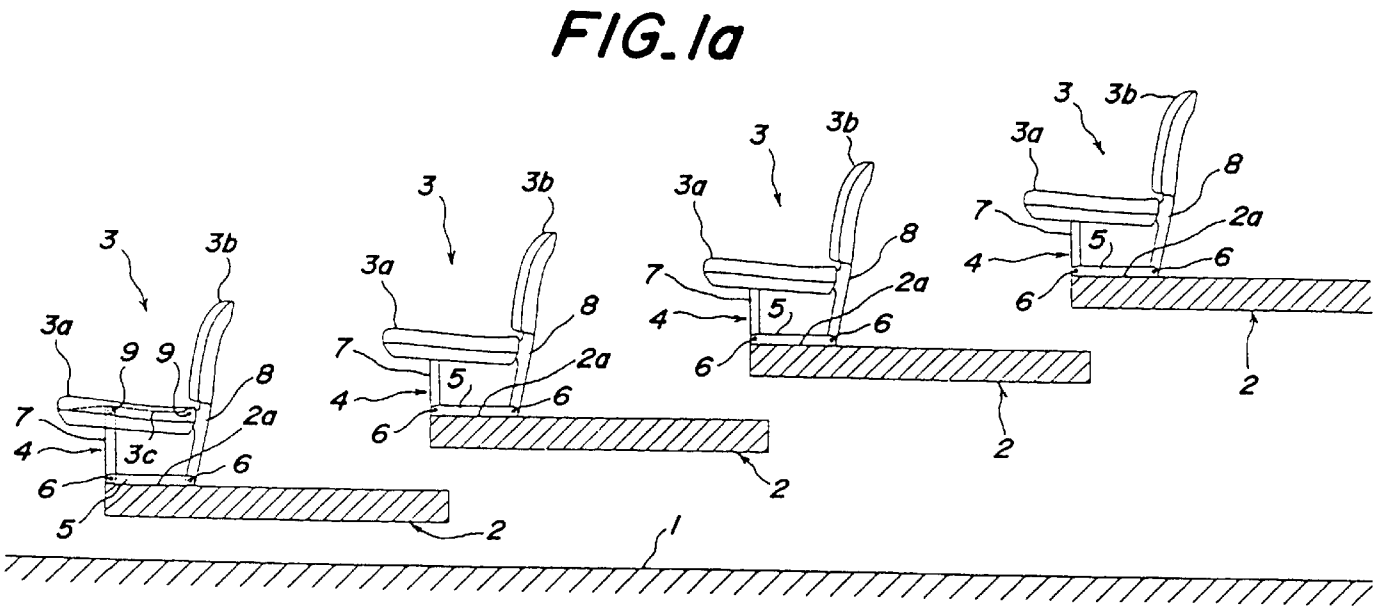
FIG. 1*a* is a cross-sectional view illustrating the retractable stairs-like stand according to a first embodiment of the present invention, in the expanded/spread state.
FIG. 1*b* is a cross-sectional view illustrating the retractable stairs-like stand in the contracted/received state.
FIG. 1*c* is a cross-sectional view illustrating the operation situation of respective seats of the retractable, stairs-like stand.
Figure 2:
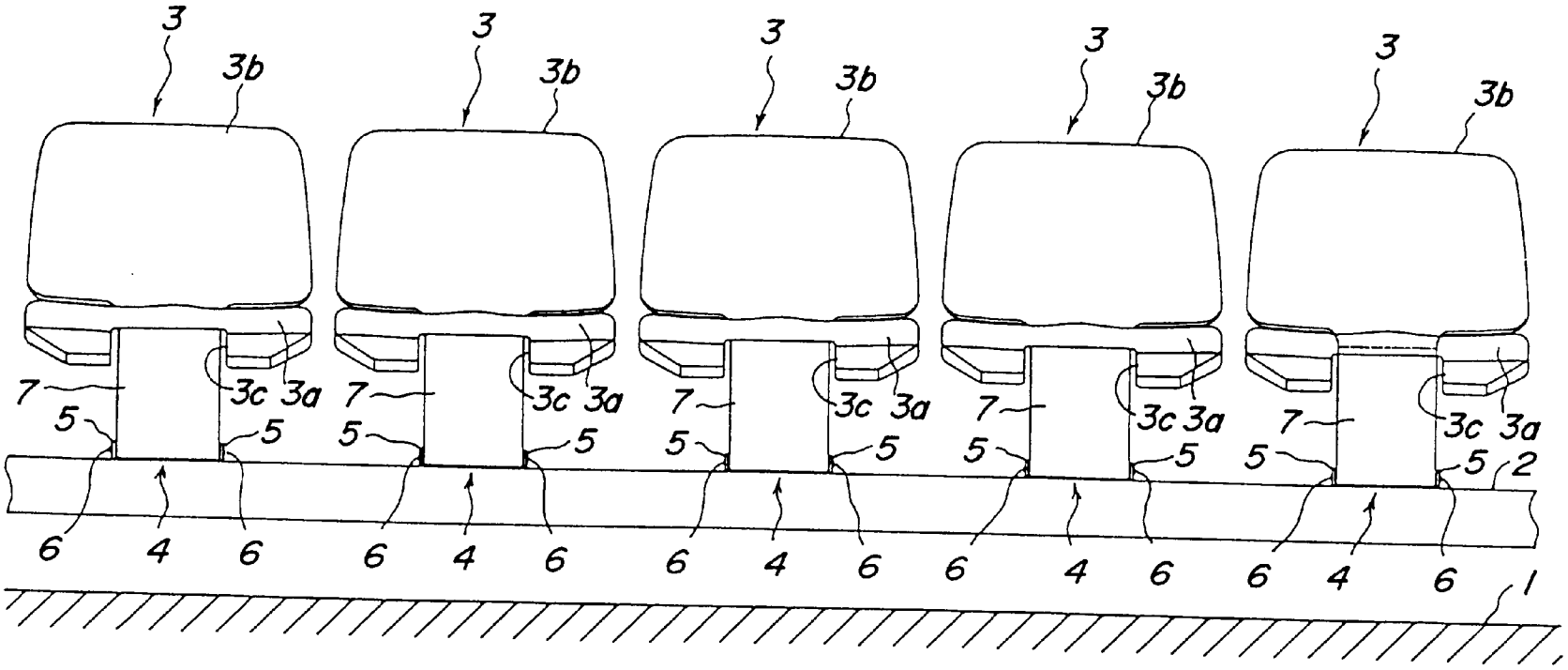
FIG. 2 is an elevational view illustrating only one step of the floor-bases and seats of the stairs-like stand of the first embodiment.
Figure 3:
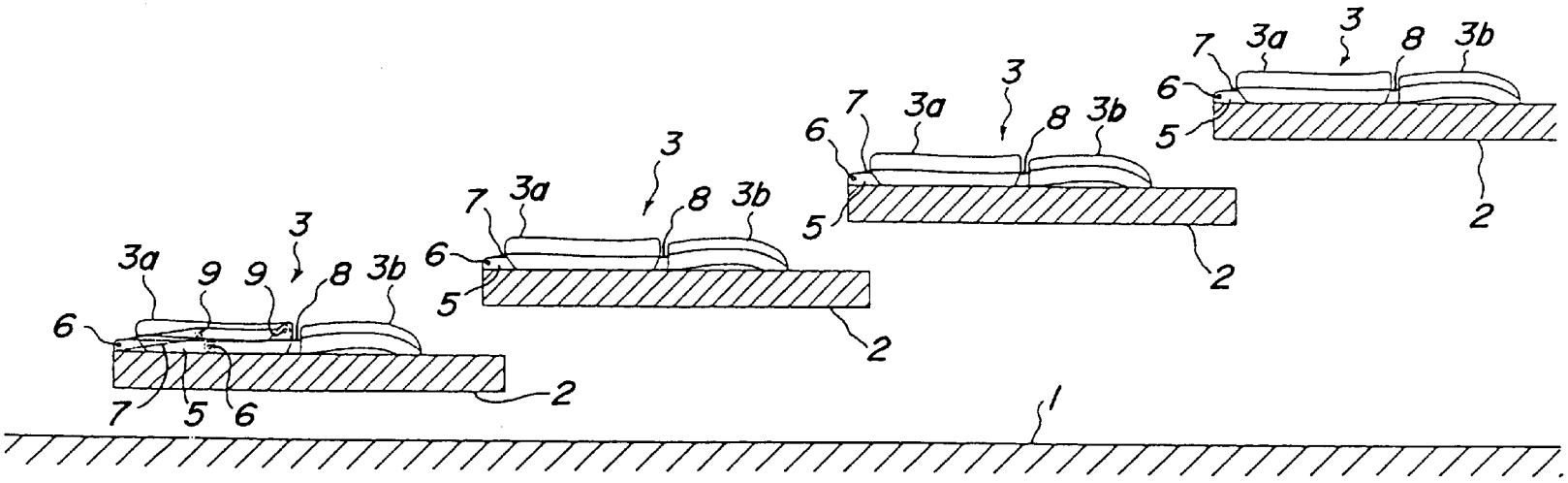
FIG. 3 is a cross-sectional view illustrating the transition situation of the stairs-like stand of the first embodiment in which the respective floor-bases are positioned at their advanced position while the seat sections of respective seats are positioned at their descent position.

A first embodiment of the retractable stairs-like stand according to the present invention will be explained below with reference to FIGS. 1*a*–1*c* and also to FIGS. 2 and 3. FIG. 1*a* shows the stairs-like stand in its expanded/spread state, FIG. 1*b* shows the stairs-like stand in its contracted/received state, and FIG. 1*c* shows the operation situation of respective seats of the stairs-like stand. FIG. 2 is an elevational view illustrating only one step of the floor-bases and seats of the retractable, stairs-like stands of the first embodiment. FIG. 3 illustrates the transition situation of the stairs-like stand in which the respective floor-bases are positioned at the advanced position while the respective seats are positioned at their stand-by position. Throughout the drawings, reference numeral 1 represents a floor face of an institution such as a hall onto which the stands are installed.

The retractable stairs-like stand according to the first embodiment has plural steps, four steps in the drawings, of floor-bases 2 which are moved horizontally on the floor face 1 between the advanced position where the floor-bases are shifted into a form of stairs, as shown in FIGS. 1*a*, and 1*c* and FIG. 3, and the retracted position where the floor-bases are lined up along the vertical direction, as shown in FIG. 1*b*. It should be noted that the floor-bases 2 expand in the direction perpendicular to the paper surfaces on which the respective figures are drawn. In the first embodiment, the horizontal movement of the floor-bases 2 between the advanced and retracted positions is accomplished by a known structure, not shown, in which supporting legs having wheeled at their lower end portions are disposed at the rear end portions of the respective steps of the floor-bases 2 in a manner that the length and arrangement of the legs are different for each step of the floor-bases. The supporting legs are driven by a floor-base driving unit, not shown, which is equipped with an electric motor. In FIGS. 1*a*–1*c* and FIG. 3, the left side corresponds to the front of the stands.

As illustrated in FIGS. 1*a*–1*c* and FIGS. 2 and 3, the retractable stairs-like stand has plural seats 3 with which each of the plural steps of the floor-bases 2 is furnished. In this embodiment, each seat 3 has a seat section 3*a* and a back 3*b* which are separated from each other. In this embodiment, as shown in FIG. 2, a plurality of the seats 3, five seats 3 in FIG. 2, are arranged along the right and left direction on the front portion 2*a* of the floor-base 2. These seats 3 are independently fitted to the floor-base 2 through a link mechanism constituting a parallel link 4 (which is referred to as a "parallel link mechanism" herein, for convenience of the explanation).

As shown in FIGS. 1*a*–1*c* and FIG. 2, in the parallel link mechanism, supporting axes 6 expanding along the right and left direction of the floor-base 2 (the direction perpendicular to the paper on which FIGS. 1*a*–1*c* are drawn) are disposed at two positions, the front and rear positions of a bracket 5 fixed onto the front portion 2*a* of each step of the floor-base 2, along the back and forth direction. The lower end portions of two link members, that is, a front link member 7 and rear link member 8 having a width one-third as wide as the respective seat sections 3*a* are rotatably jointed to the bracket 5, respectively, by means of the supporting axes 6. Furthermore, recess 3*c* having such a width that the link members 7 and 8 can be received is formed at the center of the lower side of the seat section 3*a* of the seat 3. Supporting axes 9 are disposed in parallel to the supporting axes 6, at substantially the same interval as that between the front and rear two supporting axes 6, at two front and rear positions inside the recess 3*c*. By means of the supporting axes 9, the upper end portion of the front link member 7, and the middle point of the rear link member 8, the point being spaced from the lower end of the member 8 by a distance which is substantially equal to the length of the front link member 7, are jointed to the seat section 3*a*. In this embodiment, back 3*b* of the seat 3 is fixed onto the upper portion of the rear link member 8.

In the first embodiment, when the front and rear link members 7 and 8 of the parallel link mechanism 4 are rotated about their supporting axes 6, the seat section 3*a* of each seat 3 can be moved substantially in parallel back and forth between the use-position where the seat section 3*a* is away from the floor-base 2, as shown in FIGS. 1*a* and 2 and by the solid lines in the FIG. 1*c*, and the descent (or stowage) position where the lower face of the seat section 3*a* contacts the floor-base 2, as shown in FIGS. 1*c* and 2 and by the imaginary line in FIG. 1*c*. Simultaneously, by rotation of the rear link member 8 about the supporting axes 6, the back 3*b* of each seat 3 can be also rotated between the use-position where the back 3*b* stands up away from the floor-base 2, as shown in FIGS. 1*a* and 2 and by the solid lines in the FIG. 1*c*, and the collapsed (or stowage) position where, behind the descent position, the back 3*b* contacts the floor-base 2 to lie on its back face, as shown in FIGS. 1*c* and 3 and by the imaginary line in FIG. 1*c*.

In this example, the respective parallel link mechanisms 4 are provided with fastening mechanisms (not shown) as fixing means for selectively fixing the seat section 3*a* to the use-position or releasing the seat section 3*a* from the use-position. The fastening mechanism may be a structure, for example, in which a fastening member such as a hook or a lock is supported onto the floor-base 2 so that the set section 3*a* can be moved between the fastening position where the seat section 3*a* is fastened to the front link member 7 when the front link member 7 is rotated to the use-position, and the separation position where the seat section 3*a* is moved away from the front link member 7. A spring may be disposed to normally urge the fastening member toward the fastening position. It may be the rear link member 8, instead of the front link member 7, which is to be fastened. Alternatively, the seat section 3*a* may be directly fastened to the use-position, instead of fastening the front or rear link member 7 or 8.

As shown in FIG. 1*a*, when the stairs-like stand according to the first embodiment with the above-mentioned structure are used, the plural steps of the floor-bases 2 are moved into the advanced position where they are mutually shifted into a form of stairs, and then the backs 3*b* are manually held up so that the backs 3*b* of the respective sets 3 are moved in parallel forwards by the rotation of the two link members 7 and 8 of the parallel link mechanism 4 on the front portions 2*a* of the respective floor-bases 2. Thus, the seat sections 3*a* are positioned at the use-position where the seat sections 3*a* are spaced away from the floor-bases 2. Simultaneously, the backs 3*b* jointed to the rear link members 8 are rotated about the rear supporting axes 6, so that the backs 3*b* are positioned at the use-position where the backs 3*b* stand up away from the floor-bases 2. In this state, the seat sections 3*a* are fixed to the use-position with the fastening mechanisms. In this manner, the retractable stairs-like stand is expanded and spread.

As shown in FIGS. 1*c* and 3, when the stairs-like stand of the first embodiment with the above-mentioned structure is not in use, the seat section 3*a* are released, from the fastened state at the use-position, by manually operating the fastening mechanism, and then the backs 3*b* of the respective sets 3 are manually tumbled backward so that the backs 3*b* of the respective sets 3 are moved in parallel backwards by reverse rotation (to that in use) of the two link members 7 and 8 of the parallel link mechanism 4 on the front portions 2*a* of the respective floor-bases 2. Thus, the seat sections 3*a* are positioned at the descent position where the lower faces of the sections 3*a* contact the floor-bases 2. Simultaneously, the backs 3*b* jointed to the rear link members 8 are rotated about the rear supporting axes 6 so that the backs 3*b* are positioned at the collapsed position where the backs 3*b* contact the floor-bases 2 to lie on their back faces. Subsequently, as shown in FIG. 1*b*, the plural steps of the floor-bases 2 are moved to the retracted position where the plural seats 3 are lined up along the vertical direction, whereby the plural seats 3 are received between the plural steps of the floor-bases 2 and lined up in the vertical direction. Thus, the plural steps of the floor-bases 2 and the plural seats 3 fitted thereto are contracted an received to be put together in a compact body.

When the stairs-like stand of the first embodiment is not in use, the plural seats 3 are arranged between the plural steps of the floor-bases 2 so that the seat section 3*a* and the back 3*b* of each seat 3 do not overlap and are arranged before and behind. Therefore, even with a small difference in levels between the floor-bases which is fixed by the specification corresponding to the installment space, the seats 3 can be lined up along the vertical direction to be received inside the gaps between the floor-bases 2. The thickness of the seat section 3*a* and the back 3*b* can be set to a thick value within the range of the gaps between the floor-bases 2. Moreover, the seating comfort of the seat can be improved.

In the stairs-like stand according to the first embodiment, the front and rear link members 7 and 8 are disposed at the lower portions of the seat section 3*a*. Thus, the parallel link mechanism 4 is not at the side of the seat section 3*a*. For this reason, the width of the seat section 3*a* is made wide inside the limited seat receiving space so as to improve comfortableness.

Figures 4A, 4B, 4C:
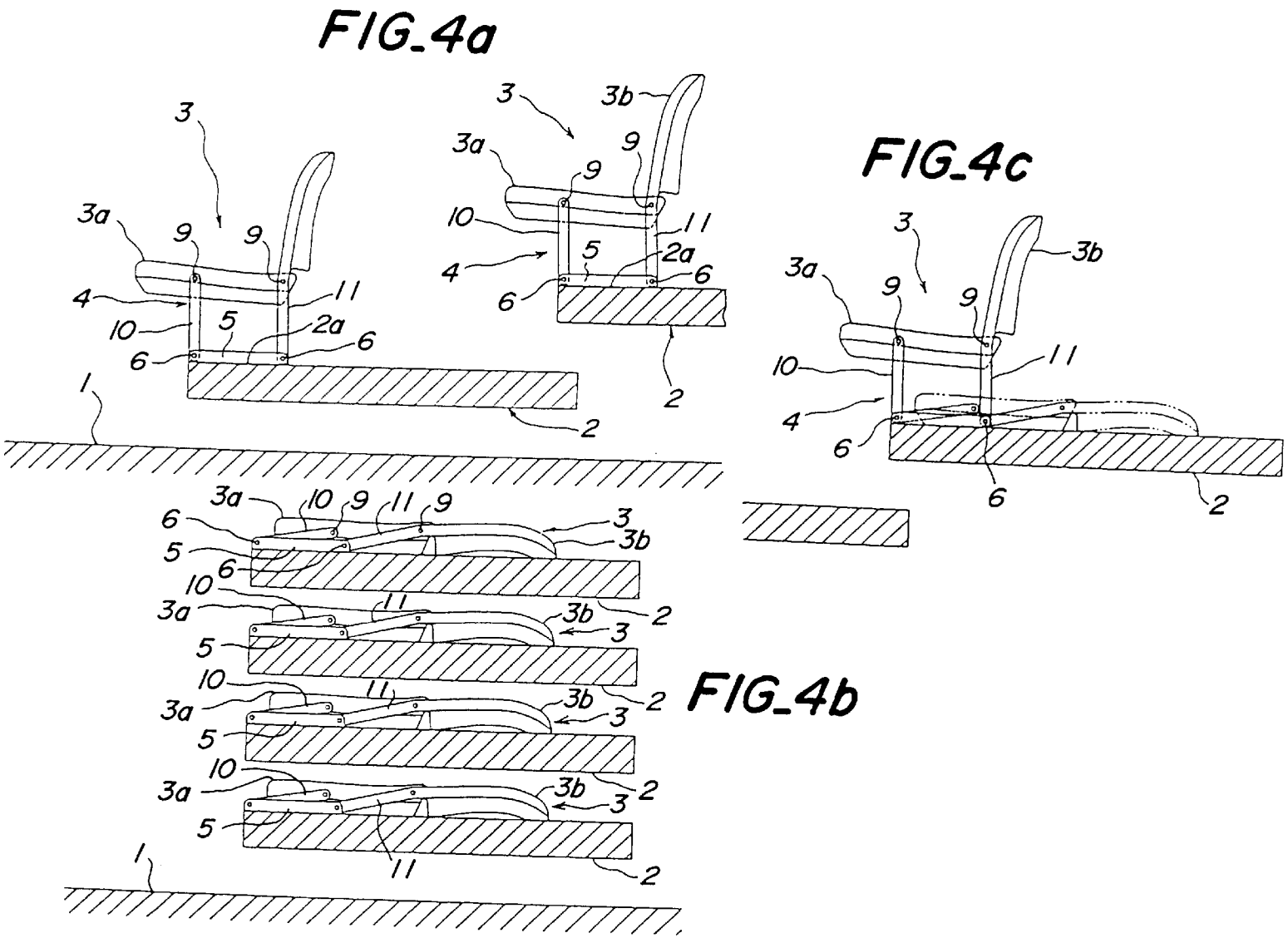
FIG. 4*a* is a cross-sectional view illustrating the structure corresponding to only two steps of the floor-bases in the second embodiment of the stairs-like stand according to the present invention, at the expanded/spread state.
FIG. 4*b* is a cross-sectional view illustrating the stairs-like stand of the second embodiment in the contracted/received state.
FIG. 4*c* is a cross-sectional view illustrating the operation situation of respective seats of the stairs-like stands of the second embodiment.
Figure 5:
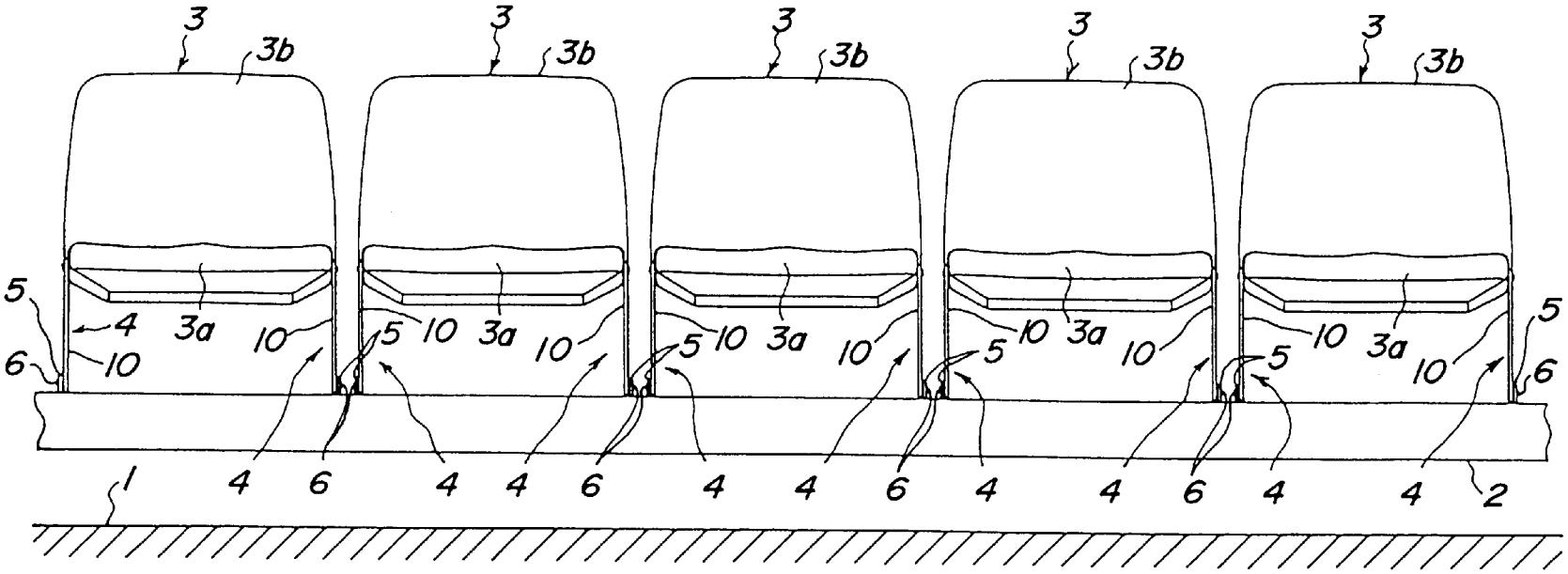
FIG. 5 is an elevational view illustrating only one step of the floor-bases and seats of the stairs-like stand of the second embodiment.

A second embodiment of the retractable, stairs-like stand according to the present invention will be explained below, with reference to FIGS. 4*a*–4*c* and FIG. 5. FIG. 4*a* illustrates the structure corresponding to only two steps of the floor-bases in the expanded/spread state, FIG. 4*b* illustrates the stairs-like stands in its contracted/received state, and FIG. 4*c* illustrates the operation situation of respective seats of the stairs-like stands. FIG. 5 illustrates only one step of the floor-bases and seats of the retractable, stairs-like stands of the second example. In these drawings, elements corresponding to those in the first embodiment are denoted by the same references numerals.

As shown in FIGS. 4*a*–4*c* and FIG. 5, the stairs-like stands according to the second embodiment has two front link members 10 and two rear link members 11, as the parallel link mechanism 4 for supporting the seat section of each seat 3 and moving it substantially in parallel with each other. The lower end portions of the link members 10 and 11 are rotatably jointed to the bracket 5 with the supporting axes 6, and further by means of the supporting axes 9, the upper end portion of the front link member 10, and the middle point of the rear link member 11, the point being spaced from the lower end of the member 10 by a distance which is substantially equal to the length of the front link member 10, are rotatably jointed to the right and left sides of each seat section 3*a*.

In the second embodiment, when the front and rear link members 10 and 11 of the parallel link mechanism 4 are rotated about their supporting axes 6, the seat section 3*a* of each seat 3 can be in substantially moved in parallel, in the back and forth direction between the use-position where the seat section 3*a* is away from the floor-base 2, as shown in FIGS. 4*a* and 5 and by solid lines in the FIG. 4*c*, and the descent position where the lower face of the seat section 3*a* contacts the floor-base 2, as shown in FIGS. 4*c* and 5 and by the imaginary in FIG. 4*c*. At that time, by rotation of the rear link member 11 about the supporting axes 6, the back 3*b* of each seat 3 can be also rotated between the use-position where the back 3*b* stands up away from the floor-base 2, as shown in FIGS. 4*a* and 5 and by the solid lines in FIG. 4*c*, and the collapsed position where, behind the descent position, the back 3*b* contacts the floor-base 2 to lie on its back face, as shown in FIG. 4*b* and by the imaginary line in FIG. 4*c*.

In the second embodiment, structural features other than the above are substantially the same as in the first embodiment. Thus, the back 3*b* of the seat 3 is fixed onto the upper portion of the rear link member 11. Also, a fastening mechanism (not shown) as a fixing means is added to the respective link mechanisms 4, for selectively fixing the seat section 3*a* to the use-position or releasing the seat section 3*a* from the use-position.

As shown in FIG. 4*a*, when the stairs-like stand of the second embodiment with the above-mentioned structure is used, the plural steps of the floor-bases 2 are moved into the advanced position where they are mutually shifted into a form of stairs, and then the backs 3*b* are manually held up so that the backs 3*b* of the respective sets 3 are moved in parallel forwards by the rotation of the two link members 10 and 11 of the parallel link mechanism 4 on the front portions 2*a* of the respective floor-bases 2. Thus, the seat sections 3*a* are positioned at the use-position where the sections 3*a* are away from the floor-bases 2. Simultaneously, the backs 3*b* jointed to the rear link members 11 are rotated about the rear supporting axes 6 so that the backs 3*b* are positioned at the use-position where the backs 3*b* stand up away from the floor-bases 2. In this state, the seat sections 3*a* are fixed to the use-position with the fastening mechanisms. In this manner, the retractable, stairs-like stands are expanded and spread.

As shown in FIG. 4*c*, when the stairs-like stand of the second embodiment with the above-mentioned structure is not in use, the seat sections 3*a* are released from the fastened state at the use-position by manually operating the fastening mechanism, and then the backs 3*b* of the respective seats 3 are manually tumbled backward so that the backs 3*b* of the respective seats 3 are moved in parallel backwards by reverse rotation (to that in use) of the two link members 10 and 11 of the parallel link mechanism 4 on the front portions 2*a* of the respective floor-bases 2. Thus, the seat sections 3*a* are positioned at the descent position where the lower faces of the sections 3*a* contact the floor-bases 2. Simultaneously, the backs 3*b* jointed to the rear link members 8 are rotated about the rear supporting axes 6 so that the backs 3*b* are positioned at the collapsed position where the backs 3*b* contact the floor-bases 2 to lie on their back faces. Subsequently, as shown in FIG. 1*b*, the plural steps of the floor-bases 2 are moved to the retracted position where the plural seats 3 are lined up along the vertical direction, whereby the plural seats 3 are received between the plural steps of the floor-bases 2 and lined up in the vertical direction. Thus, the plural steps of the floor-bases 2 and the plural seats 3 fitted thereto are contracted an received to be put together in a compact body.

When the stairs-like stand of the second embodiment is not in use, the plural seats 3 are arranged between the plural steps of the floor-bases 2 so that the seat section 3*a* and the back 3*b* of each seat 3 do not overlap and are arranged before and behind, in the same manner as in the first example. Therefore, even with a small difference in levels between the floor-bases which is fixed by the specification corresponding to the installment space, the seats 3 can be lined up along the vertical direction to be received inside the gaps between the floor-bases 2. The thickness of the seat section 3*a* and the back 3*b* can be also set to a thick value within the range of the gaps between the floor-bases 2, whereby the comfortableness of the seat is improved.

In the stairs-like stand according to the second embodiment, the front and rear link members 10 and 11 are disposed at the sides of the seat section 3*a*. Thus, the parallel link mechanism 4 is not at the lower portion of the seat section 3*a*. For this reason, the width of the seat section 3*a* is sufficiently made wide inside the limited seat receiving space, and the seat section 3*a* may be a structure which is covered with cloth or a leather and has inside a thick cushion, thereby improving comfortableness.

Figure 6:
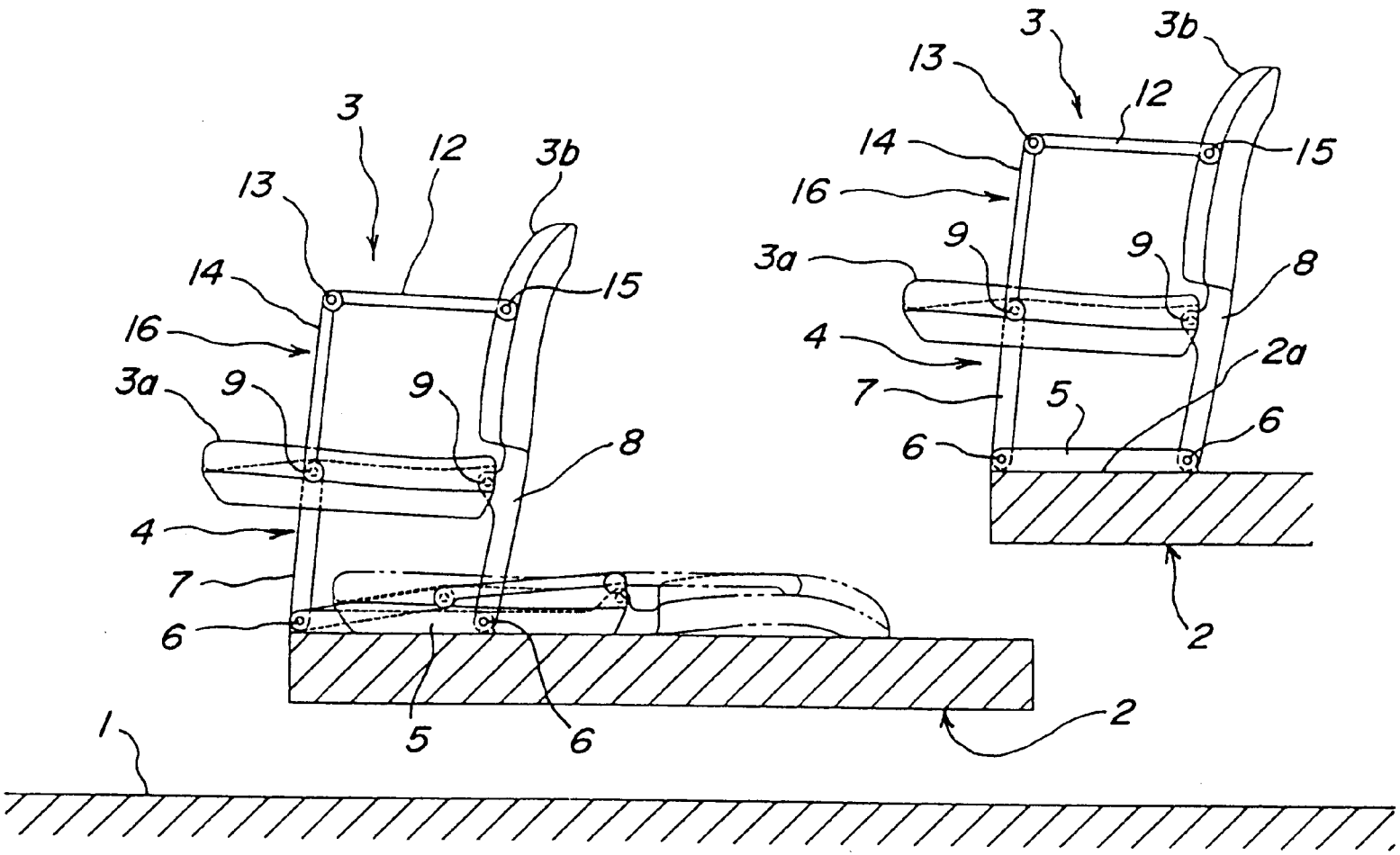
FIG. 6 is an elevational view illustrating the structure corresponding to only two steps of the floor-bases in a variation of the first embodiment of the stairs-like stand in the expanded/spread state.
Figure 7:
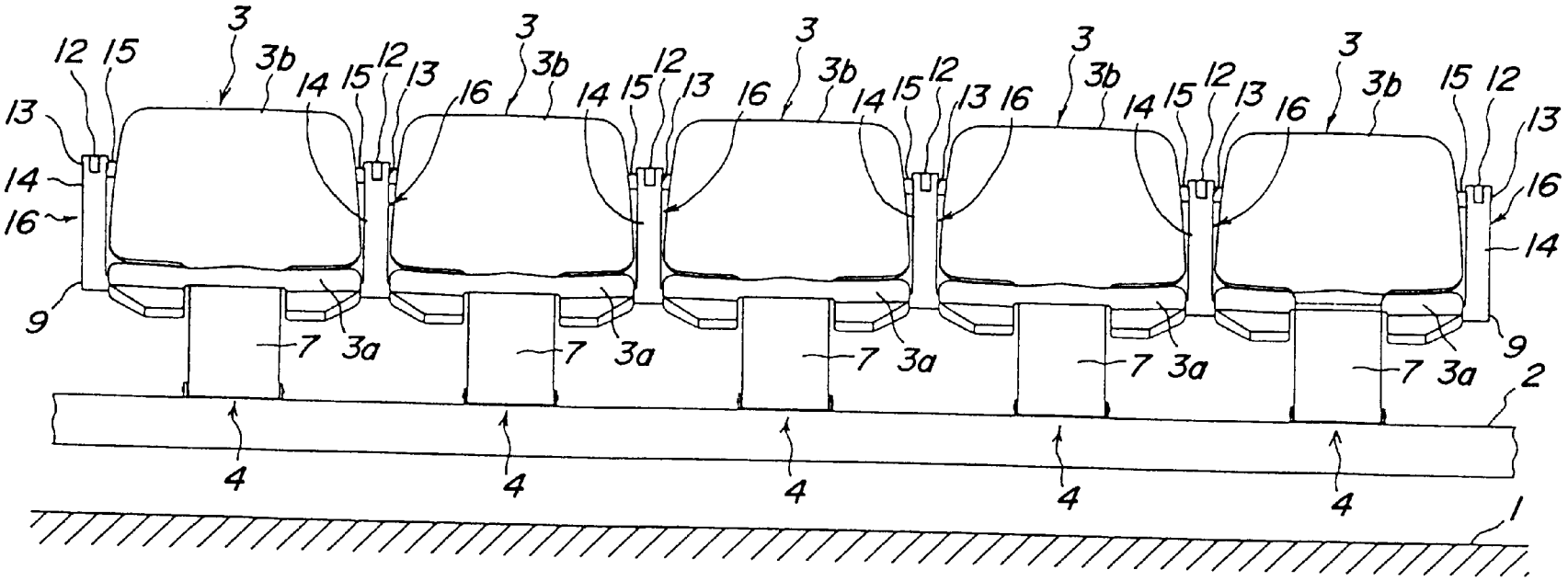
FIG. 7 is an elevational view illustrating only one step of the floor-bases and seats of the above-mentioned variation.

A variation which can be applied to the first embodiment will be explained below with reference to FIGS. 6 and 7. FIG. 6 illustrates the structure corresponding to only two steps of the floor-bases in the expanded/spread state, and FIG. 7 illustrates only one step of the floor-bases and seats. In these drawings, the elements corresponding to those of the first embodiment are denoted by the same reference numerals.

In this variation, armrests 12 are disposed at the respective seats 3. The front end of the armrest 12 is rotatably jointed to the upper end of a supporting pole 14 by means of a jointing axis 13, and the rear end of the armrest 12 is rotatably jointed to the back 3*b* integrated/jointed to the rear link member 8 of the parallel link mechanism 4 by means of a jointing axis 15. Furthermore, the lower end of the supporting pole 14 is rotatably jointed to the seat section 3*a* by means of the supporting axis 9 expanding along the axial direction. In this instance, the supporting pole 14 and the back 3*b* constitute another parallel link mechanism 16 which is jointed to the parallel link mechanism 4 through the back 3*b*. The armrest 12 is in substantially parallel moved back and forth between the use-position where the armrest 12 is spaced from the floor-base 2, which is shown in FIG. 7 and by solid lines in FIG. 6, and the descent position where the armrest approximates to the floor-base 2, which is shown by the imaginary line in FIG. 6.

The above-mentioned variation makes it possible to provide the same advantages as by the first embodiment, since the parallel link mechanism 16 for moving the armrest 12 works together with the parallel link mechanism 4, and further to improve the seating comfort of the seat 3 by the armrest 12.

Figure 8:
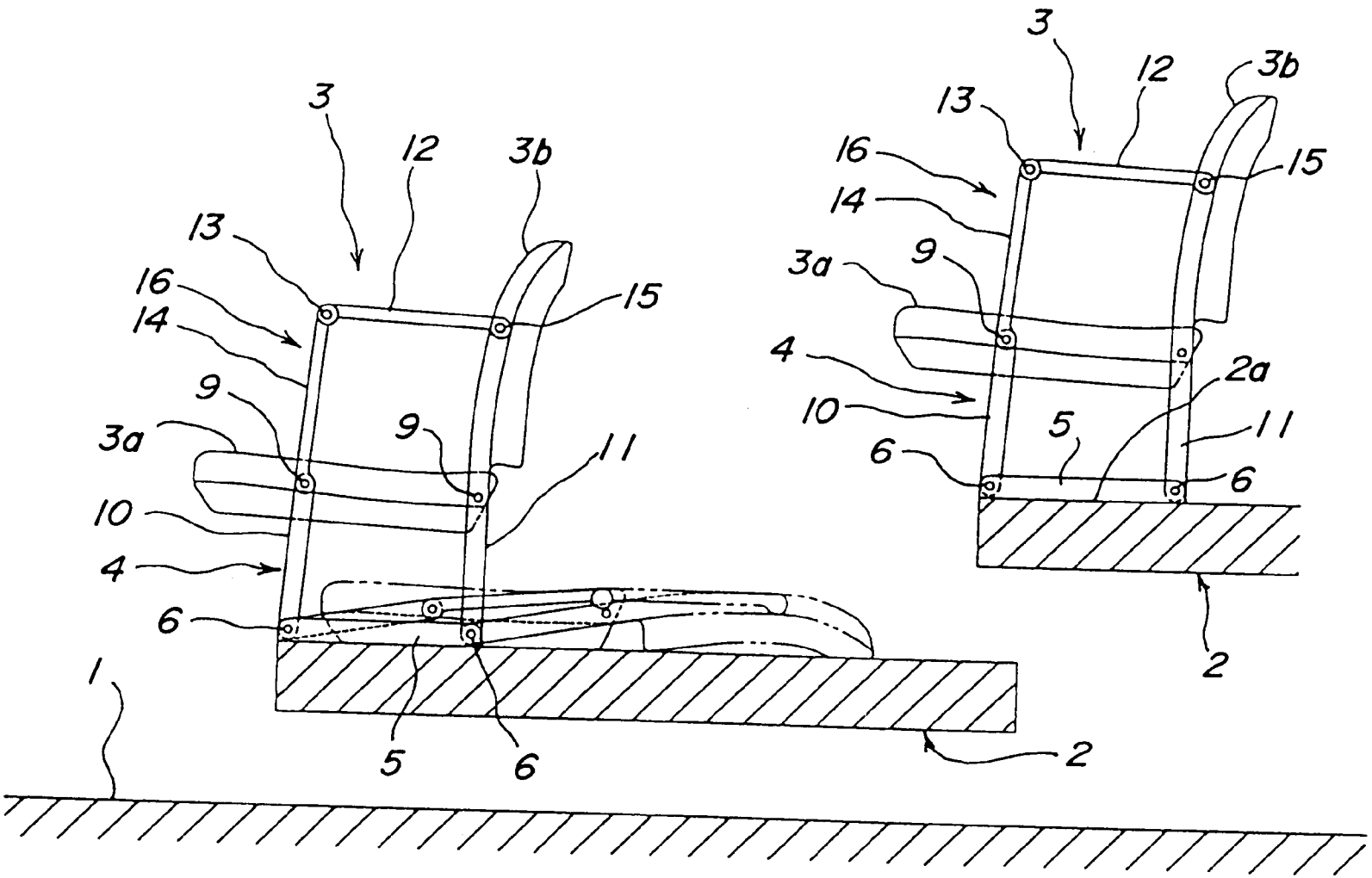
FIG. 8 is an elevational view illustrating the structure corresponding to only two steps of the floor-bases in the second embodiment of the stairs-like stand in the expanded/spread state.
Figure 9:
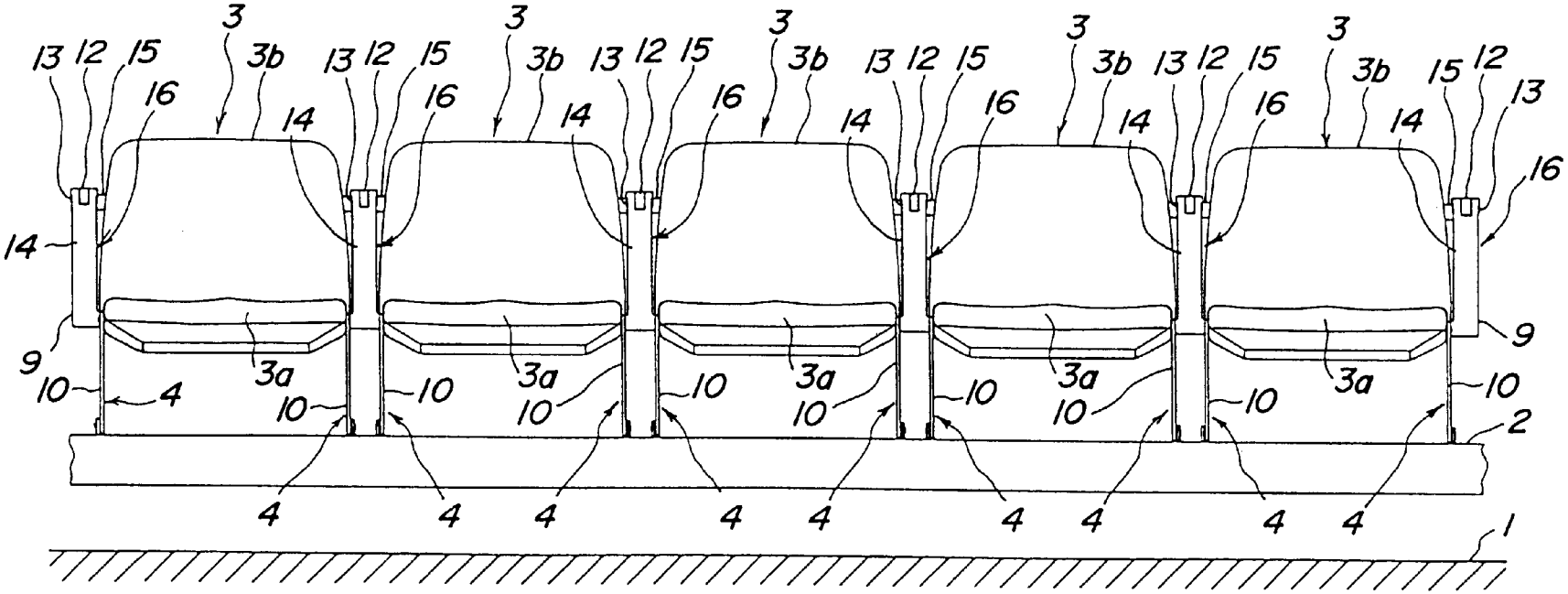
FIG. 9 is an elevational view illustrating only one step of the floor-bases and seats of the above-mentioned variation.

Another variation which can be applied to the second embodiment will be explained below with reference to FIGS. 8 and 9. FIG. 8 illustrates the structure corresponding to only two steps of the floor-bases, and FIG. 9 illustrates only one step of the floor-bases and seats. In these drawings, the elements corresponding to those of the second embodiment are denoted by the same reference numerals.

In this variation, armrests 12 are disposed at the respective seats 3 in the same manner as in the previous variation. The front end of the armrest 12 is rotatably jointed to the upper end of a supporting pole 14 by means of a jointing axis 13, and the rear end of the armrest 12 is rotatably jointed to the back 3*b* integrated/jointed to the rear link member 11 of the parallel link mechanism 4 by a jointing axis 15. Furthermore, the lower end of the supporting pole 14 is rotatably jointed to the seat section 3*a* by means of the supporting axis 9 expanding along the axial direction. In this instance, the supporting pole 14 and the back 3*b* constitute another parallel link mechanism 16 jointed to the parallel link mechanism 4 through the back 3*b*. The armrest 12 is in substantially moved back and forth in parallel, between the use-position where the armrest 12 is away from the floor-base 2, which is shown in FIG. 9 and by the solid lines in FIG. 8, and the descent position where the armrest approximates to the floor-base 2, which is shown by the imaginary line in FIG. 8.

This variation makes it possible to provide the same advantages as by the second example since the parallel link mechanism 16 for moving the armrest 12 works together with the parallel link mechanism 4, and further to improve the seating comfort of the seat 3 by the armrest 12. Instead of disposing the supporting pole 14, the front link member 10 of the parallel link mechanism 4 is expanded upward so that to the upper end thereof the front end portion of the armrest 12 may be jointed.

The present invention has been described above with reference to specific embodiments which are presently considered as the best mode of the invention, and which do not in anyway limit the scope of the invention as defined by the appended claims.

It is of course that various modifications may be made without departing from the scope of the invention. Thus, if desired, the seats may be jointly rotated, for example with the movement of the floor-bases, using a wire, cam or the like, whereby the floor driving unit also serves as the driving means for rotating the seats. The driving means for rotating the seats may be one for rotating the seats in a single direction, that is, from the descent position to the use-position, or from the use-position to the descent position by means of a spring, so that rotation in the reverse direction is carried out by one's hand. Alternatively, a driving unit for exclusively using the seat sections of the seats to move them, for example, which has a motor and a reduction gear train, or further has a brake may be disposed at each of the seats as the aforementioned driving means. Plural seat sections may be disposed so as to work together. In this case, this driving unit may also function as the aforementioned fixing means for selectively fixing the seat sections to the use-position or releasing them from the use-position.

According to the present invention, a plurality of the seat sections may be jointed in a single body, and the parallel link mechanisms may make the seat sections jointed in a single body to move between the use-position and the descent position. Furthermore, a plurality of the backs of the seats may be jointed in a single body, and the parallel link mechanisms jointed to the backs may make the backs jointed in a single body rotate between the use-position and the collapsed position. Of course, as the case may be, the number of steps of the floor-bases or the number of the seats may be altered suitably.

I claim:

1. A retractable stairs-like stand comprising plural steps of floor-bases which are moved horizontally between an advanced position where the floor-bases are mutually shifted into a form of stairs and a retracted position where the floor-bases are mutually lined up in the vertical direction, and plural seats fitted onto the floor-bases, said seats having collapsible seat section and backs, said stand further comprising:

parallel link mechanisms for moving the seat sections of the seats rearwardly and parallel to the floor-bases while moving between a use-position where the seat sections are away from the floor-bases and a stowage position where the seat sections are stowed immediately adjacent the floor-bases, at front portions of the respective floor-bases; and said parallel link mechanism comprising plural link members having bottom portions pivotally attached to fixed positions on said floor-bases, rear ones of said link members being attached to the backs of the seats, the backs being rotatable rearwardly between the use-position where the backs stand up away from the floor-bases and the stowage position where the backs are stowed immediately adjacent the floor-bases behind the stowage position of the seat sections and lying on their back faces, following the movement of the plural link members.

2. The retractable stairs-like stand according to claim 1, wherein the plural link members are at the right and left sides of the seat sections.

3. The retractable, stairs-like stand according to claim 1, wherein the plural link members are disposed below the seat sections.

4. The retractable stairs-like stand according to claim 1, further comprising another link mechanism for moving armrests jointed to the parallel link mechanisms in parallel while moving back and forth between the use-position where the armrests are away from the floor-bases and the stowage position where the armrests are stowed immediately adjacent to the floor-bases.

5. The retractable stairs-like stand according to claim 1, wherein the plural seat sections are jointed in an integrated body, and moved together by the parallel link mechanisms between the use-position and the stowage position.

6. The retractable stairs-like stand according to claim 1, wherein the plural backs are jointed in an integrated body, and rotated together by link members connected thereto, between the use-position and the stowage position.

7. The stand of claim 1, wherein bottoms of said seat sections directly contact said floor-bases in the stowage position.

8. The stand of claim 1, wherein said back faces of said backs directly contact said floor-bases in the stowage position.

9. The stand of claim 1, wherein each of said plural link members is a single planar component pivotally affixed to a center of its respective seat section and having a width less than a width of the respective seat section.

10. A retractable stand comprising:

plural floor sections that are movable between a stowed position in which said floor sections are aligned atop one another and a use position in which said floor sections are displaced from atop one another to form stairs;

each of said floor sections having plural collapsible seats attached thereto;

each of said seats comprising a seat section supported by spaced apart front and rear link members and a back attached to said rear link member, each of said front and rear link members having floor ends that are pivotally attached to a fixed position on a respective one of said floor sections and seat ends that are pivotally attached to respective fixed positions at front and rear parts of said seat section; and said seat section being movable rearwardly from a seating position in which said link members are erect to a stowage position in which both said link members are pivoted generally parallel to said respective floor section and beneath said seat section, said seat section being arranged and constructed to remain parallel to said respective floor section during movement of said seat section between the seating and stowage positions, a rear surface of said back being generally coplanar with said seat section and contacting said respective floor section when said seat section is in the stowage position.

11. The stand of claim 10, wherein one of said link members has a longitudinal side contacting said respective floor section when said seat section is in the stowage position.

12. The stand of claim 10, wherein a bottom of said seat section contacts said respective floor section when said seat section is in the stowage position.

13. The stand of claim 10, wherein said front link member is a single planar component supporting a center portion of a front of said seat section.

14. The stand of claim 10, wherein said rear link member is a single planar component supporting a center portion of a rear of said seat section.

15. The stand of claim 10, wherein said front link member comprises two support components supporting opposing sides of a front of said seat section.

16. The stand of claim 10, wherein said rear link member comprises two support components supporting opposing sides of a rear of said seat section.

* * * * *